United States Patent [19]

Reiss et al.

[11] Patent Number: 4,802,462

[45] Date of Patent: Feb. 7, 1989

[54] MUSCLE EXERCISE AND REHABILITATION APPARATUS FOR THE UPPER LUMBAR REGION

[75] Inventors: James M. Reiss, Setauket; Walter Gezari, New York; Robert Stidd, Center Moriches, all of N.Y.

[73] Assignee: Biodex Corporation, Shirley, N.Y.

[21] Appl. No.: 136,017

[22] Filed: Dec. 21, 1987

[51] Int. Cl.[4] ..... A61H 1/02

[52] U.S. Cl. ..... 128/25 R; 272/134

[58] Field of Search ..... 272/129, 134, 144, 93; 73/379; 297/378, 361, 354, 356; 128/25 R, 68, 1, 75

[56] References Cited

U.S. PATENT DOCUMENTS

| | | | |
|---|---|---|---|
| 1,973,945 | 9/1934 | Chavin et al. | 272/134 |
| 3,641,995 | 2/1972 | Brandt | 128/25 |
| 3,975,051 | 8/1976 | Ballagh | 297/434 |
| 4,215,680 | 8/1980 | Okuda | 128/25 R |
| 4,462,252 | 7/1984 | Smidt et al. | 272/134 |
| 4,565,368 | 1/1986 | Boettcher | 272/129 |
| 4,647,066 | 3/1987 | Walton | 297/354 |
| 4,666,152 | 5/1987 | Jones | 272/134 |
| 4,669,724 | 6/1987 | Matheisen | 272/145 |
| 4,702,108 | 10/1987 | Amundsen et al. | 272/134 |
| 4,725,056 | 2/1988 | Rehrl et al. | 128/25 R |
| 4,732,381 | 3/1988 | Showronski | 272/134 |

*Primary Examiner*—Richard J. Apley
*Assistant Examiner*—J. Welsh
*Attorney, Agent, or Firm*—Cobrin, Feingertz & Godsberg

[57] ABSTRACT

A back attachment for a muscle exercise and/or rehabilitation apparatus of the type having a motor driven output shaft with a central axis, includes seat for supporting a person thereon; a back exercising frame connected to the output shaft for pivoting the back of the person about the central axis when the person is seated in the seat; a support stand for fixedly supporting the seat at a downward angle of approximately 15 degrees toward a front portion of the seat, regardless of the angle of pivot of the back exercising frame; securing straps for securing the person to the seat and back exercising frame; an adjustable foot rest connected to the seat for supporting the feet of the person, during pivoting the back exercising frame, the adjustable foot rest being adjustable along the length thereof toward and away from the seat; a lumbar support connected with the back exercising frame for supporting the lumbar region of the person about an axis offset from the central axis, during pivoting movement of the back exercising frame, in any selected one of a plurality of different positions; a scapula support for supporting the scapular region of the person; a scapular connection for adjustably connecting the scapula support to the back exercising frame; a cervical support for supporting the cervical spine of the person; and a cervical spine connection for connecting the cervical support to the back exercising frame with three degrees of freedom of adjustment.

26 Claims, 8 Drawing Sheets

FIG. 7
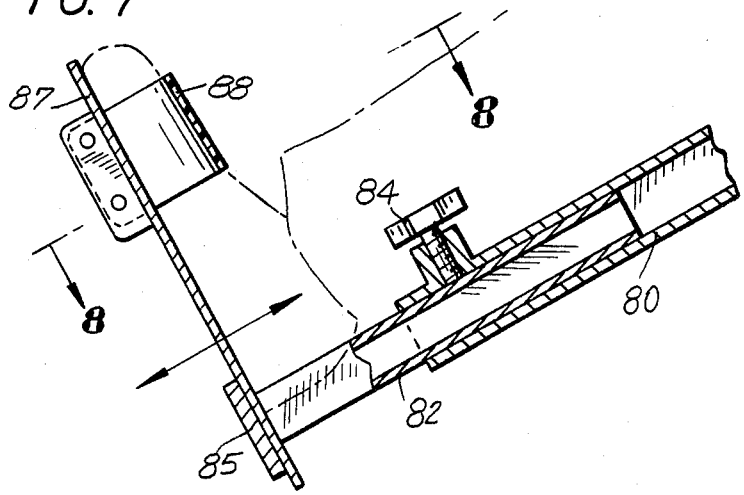
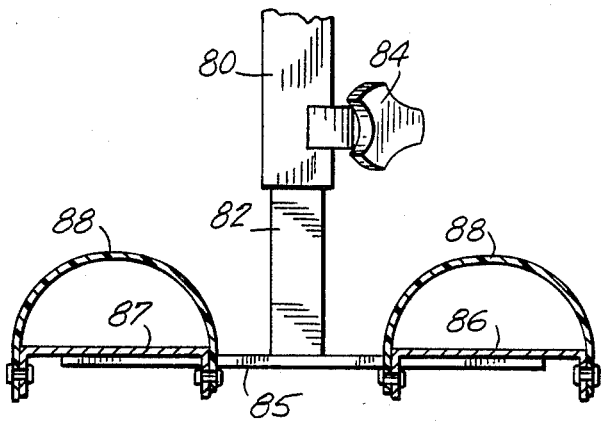
FIG. 8

MUSCLE EXERCISE AND REHABILITATION APPARATUS FOR THE UPPER LUMBAR REGION

BACKGROUND OF THE INVENTION

The present invention relates generally to muscle exercise and rehabilitation apparatus, and more particularly, is directed to such apparatus for exercise and rehabilitation of the upper lumbar region of the back.

The vertebral column is a complex structure which is designed to support loads, protect the spinal cord, and attenuate the forces that are commonly transferred to and from the trunk and arms to the lower extremities. Although structurally quite strong, the trunk is subjected to such large forces during everyday tasks that it is presently estimated that 80 percent of the general U.S. population will at some time in their lives experience a low back disorder.

The vertebral column is functionally required to move and experience loads in three planes about three distinct axes. The sagittal plane divides the body into left and right halves. Trunk flexion and extension occur in this plane about a frontal axis which goes left to right. The coronal plane divides the body into anterior and posterior parts. Lateral flexion of the trunk occurs in this plane about the anteroposterior axis. The transverse plane divides the body into superior and anterior parts. Trunk rotation occurs in this plane about a vertical axis. The apparatus according to the present invention addresses trunk flexion and extension in the sagittal plane, as will be described in greater detail hereinafter.

As to the basic anatomy of the vertebral column, the vertebral column is made up of 24 true vertebrae, seven cervical, twelve thoracic, and five lumbar. There are five sacral vertebrae which in the adult are fused together, thereby not representing true vertebrae.

There are three major curves associated with the vertebral column which are functional in the support of the body. The curve of the lumbar region and the cervical curve are referred to as secondary since they are not present at birth as is the thoracic curve. The lumbar and cervical curves are convex anteriorly, whereas the thoracic curve is convex posteriorly. There are normal deviations from vertical in the coronal plane as well.

Each vertebra is separated from adjacent vertebrae by intervertebral discs. The discs function as shock absorbers between the vertebral bodies. There are two major components of discs, a viscous inner portion called the nucleus pulposis and a tough fibrous tissue surrounding the nucleus called the annulus fibrosis. Due to the forces that the vertebral column commonly experiences, the annulus will sometimes become herniated allowing the nucleus to seep out of confinement. The flow of the nucleus out of the annulus will often impinge upon spinal nerves causing clinical problems ranging from pain to quasiparalysis. This is commonly referred to as a "slipped disc."

The individual vertebrae and intervertebral discs are stabilized by the vertebral ligaments. The posterior ligaments are those which tend to resist the vertebral column's tendency to flex, and the anterior ligaments are those which help prevent extension. The ligaments are strong and somewhat inelastic. They represent what some people call the last line of defense against range of motion injury. However, these ligaments can become injured when stretched too far.

The musculature of the vertebral column is extensive and complex. A simple classification scheme is based upon their location. The anterior vertebral muscles are those which tend to cause vertebral flexion. This group includes the abdominal muscles (rectus abdominus, the external obliques, and the internal obliques.) The psoas major and minor muscles have attachments to the anterior aspect of the vertebral column in the lumbar region. Interestingly, these muscles have a tendency to cause extension of the lumbar vertebrae.

The primary extensors are those muscles which are classified as posterior vertebral muscles. A further simplification of the muscles places them in a single group of muscles called the erector spinae. As will be explained hereinafter, the apparatus of the present invention has as one of its fundamental purposes of the assessment of the functional capacity of the lumbar mechanism in the sagittal plane.

The loads on the vertebral column come from three sources: body weight, external forces, and internal forces. Any particular vertebrae will be affected by the weight of any body mass which is superior to its location. External forces comprise any force, or weight, that is added to the system, e.g., a backpack or an object held in the hands. Since the hands attach via the arms to the shoulders, a weight held in the hands subsequently affects all of the vertebrae which are inferior to the level of the shoulder joint.

Internal forces represent any forces that are created by muscles and ligaments. The erector spinae, for example, which are found bilaterally just lateral to the vertebral column, cause the vertebral column to undergo compressive forces when they contract.

There are three basic types of forces that affect the vertebral column. In general, these are compression, shear, and torsion forces. Compression forces act predominately upon the intervertebral discs. Shear forces, however, have their predominant effect at the intervertebral foramen, the site at which spinal nerves exit from the vertebral column. Torsion forces are twisting forces and may affect both of these structures.

Tension is a force quite common in the vertebral column. During flexion of the trunk, for example, the anterior aspect of the intervertebral body undergoes compression as a result of the adjacent vertebral bodies moving closer to one another. The posterior aspect of the intervertebral disc, however, undergoes tension, as do the posterior vertebral ligaments which serve to restrict the degree of flexion which may occur.

Now, with the above as background, a problem with conventional back exercise and rehabilitation apparatus is that during motion of the back, the support for the lumbar region changes. Therefore, with a fixed lumbar support, the patient may feel discomfort and optimum results may not be obtained.

In addition, with conventional back apparatus, lordosis which is the forward curvature of the spine, that produces a hollow in the back, is not maintained throughout the entire range of motion. This, again, can cause discomfort to the patient and failure to obtain optimum results. In other words, the lumbar region may in effect become isolated which puts a great amount of stress on the joints.

Further, conventional apparatus do not provide a cervical support that can be adjusted up and down for the entire antrhropomorphic range. Also, many such apparatus do not provide for control of substitution by the lower extremities, that is, protecting the lumbar spine by enabling some use of other muscles during exercise and rehabilitation.

U.S. Pat. No. 4,666,152 discloses a lower back exercising machine, in which the seat in the first embodiment is inclined upwardly toward the front thereof. In this first embodiment, there is no adjustable foot support assembly, lumbar pad, or cervical support. Although the padded roller could generally be termed a scapula pad, this pad is not adjustable. In the second embodiment, the person leans, but does not sit, on a padded seat. Although the seat is inclined downwardly toward the front thereof, the angle of inclination is approximately 50 degrees. This is because the person leans against the seat, rather than sitting on it. Also, although a padded roller is provided, which could be deemed a scapula roller, it is not adjustable with respect to the frame.

U.S. Pat. No. 4,565,368 discloses an isokinetic exercise machine for the back muscles. However, this patent fails to cure the deficiencies of U.S. Pat. No. 4,666,152. There is no seat at all. Further, there is no adjustable foot support assembly, lumbar pad, scapula pad or cervical support in accordance with the teachings of the present invention.

Other patents which relate only peripherally, at most, to the present invention, are U.S. Pat. Nos. 3,641,995; 3,975,051; 4,215,680; and 4,669,724.

OBJECTS AND SUMMARY OF THE INVENTION

Accordingly, it is an object of the present invention to provide apparatus for back exercise and rehabilitation that addresses trunk flexion and extension in the sagittal plane.

It is another object of the present invention to provide such apparatus which can assess the functional capacity of the lumbar mechanism in the sagittal plane.

It is still another object of the present invention to provide such apparatus that provides complete stabilization and positioning of a person in order to assist in the objective assessment of the sagittal plane trunk function in extension and flexion.

It is yet another object of the present invention to provide such apparatus which permits screening, testing, rehabilitation or exercise from a sitting or straight-leg 45 degree reclined position.

It is a further object of the present invention to provide such apparatus which reduces the effects of the iliopsoas muscle, to thereby reduce the magnitude of the forces exerted on the lumbar spine, achieving a truer indicator of abdominal strength.

It is a still further object of the present invention to provide such apparatus in which the seat has a 15 degree angle relative to the horizontal so as to maintain lordosis throughout the entire range of motion of tilt the pelvis.

It is a yet further object of the present invention to provide such apparatus that maintains said 15 degree angle during the entire range of motion.

It is another object of the present invention to provide such apparatus having a swivable lumbar support pad.

It is still another object of the present invention to provide such apparatus with the axis of rotation of the lumbar region being offset from the axis of rotation of the apparatus which is the lower axis of rotation of the back.

It is yet another object of the present invention to provide such apparatus that provides separate axes of rotation for the back and the lumbar spine.

It is a further object of the present invention to provide such apparatus that permits adjustment of the axis of rotation of the lumbar spine for individual patients.

It is a still further object of the present invention to provide such apparatus in which the different axes of rotation pivot in a proportionating manner with respect to each other.

It is a yet further object of the present invention to provide such apparatus in which the scapula pad functions as an indicator of correct positioning of the seat height.

It is another object of the present invention to provide such apparatus in which the support for the lower extremities is adjustable to conrtol substitution.

It is still another object of the present invention to provide such apparatus with a knee-ankle adjustment and a hip-ankle adjustment by adjusting the length of the lower extremities support.

It is yet another object of the present invention to provide such apparatus with a cervical support that is adjustable for the entire anthropomorphical range.

It is a further object of the present invention to provide such apparatus that is easy and economical to manufacture and use.

In accordance with an aspect of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is seated on the seat means; support means for fixedly supporting the seat means at a downward angle of approximately 15 degrees toward a front portion of the seat, regardless of the angle of pivot of the back exercising means; and securing means for securing the person to the seat means and the back exercising means.

In accordance with another aspect of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is supported on the seat means; securing means for securing the person to the seat means and the back exercising means; and lumbar support means connected with the back exercising means for supporting the lumbar region of the person about an axis offset from the central axis, during pivoting movement of the back exercising means.

In accordance with still another aspect of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is supported on the seat means; securing means for securing the person to the seat means and the back exercising means; and adjustable lumbar support means connected with the back exercising means for supporting the lumbar region of the person in any selected one of a plurality of different positions.

In accordance with yet another aspect of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is seated in the seat means; securing means for securing the person to the seat means and the back exercising means; scapula support means for supporting the scapular region of the person; and scapular connection means for adjustably connecting the scapula support means to the back exercising means.

In accordance with a further object of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is seated in the seat means; securing means for securing the person to the seat means and the back exercising means; cervical support means for supporting the cervical spine of the person; and cervical spine connection means for connecting the cervical support means to the back exercising means with three degrees of freedom of adjustment.

In accordance with a still further object of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is seated in the seat means; securing means for securing the person to the seat means and the back exercising means; adjustable foot rest means connected to the seat means for supporting the feet of the person, during pivoting the back exercising means, the adjustable foot rest means being adjustable along the length thereof toward and away from the seat means.

In accordance with a yet further object of the present invention, a back attachment for a muscle exercise and/or rehabilitation apparatus of the type having a motor driven output shaft with a central axis, includes seat means for supporting a person thereon; back exercising means connected to the output shaft for pivoting the back of the person about the central axis when the person is seated in the seat means; support means for fixedly supporting the seat means at a downward angle of approximately 15 degrees regardless of the angle of pivot of the back exercising means; securing means for securing the person to the seat means and the back exercising means; adjustable foot rest means connected to the seat means for supporting the feet of the person, during pivoting the back exercising means, the adjustable foot rest means being adjustable along the length thereof toward and away from the seat means; lumbar support means connected with the back exercising means for supporting the lumbar region of the person about an axis offset from the central axis, during pivoting movement of the back exercising means, in any selected one of a plurality of different positions; scapula support means for supporting the scapular region of the person; scapular connection means for adjustably connecting the scapula support means to the back exercising means; cervical support means for supporting the cervical spine of the person; and cervical spine connection means for connecting the cervical support means to the back exercising means with three degrees of freedom of adjustment.

The above and other objects, features and advantages of the present invention will become readily apparent from the following detailed description thereof which is to be read in connection with the accompanying drawings.

BRIEF DESCRIPTION OF THE DRAWINGS

FIG. 7 is a cross-sectional view of the apparatus of FIG. 1, taken along line 7—7 thereof;

FIG. 8 is a cross-sectional view of the apparatus of FIG. 7, taken along 8—8 thereof;

DETAILED DESCRIPTION OF A PREFERRED EMBODIMENT

Figure 1:
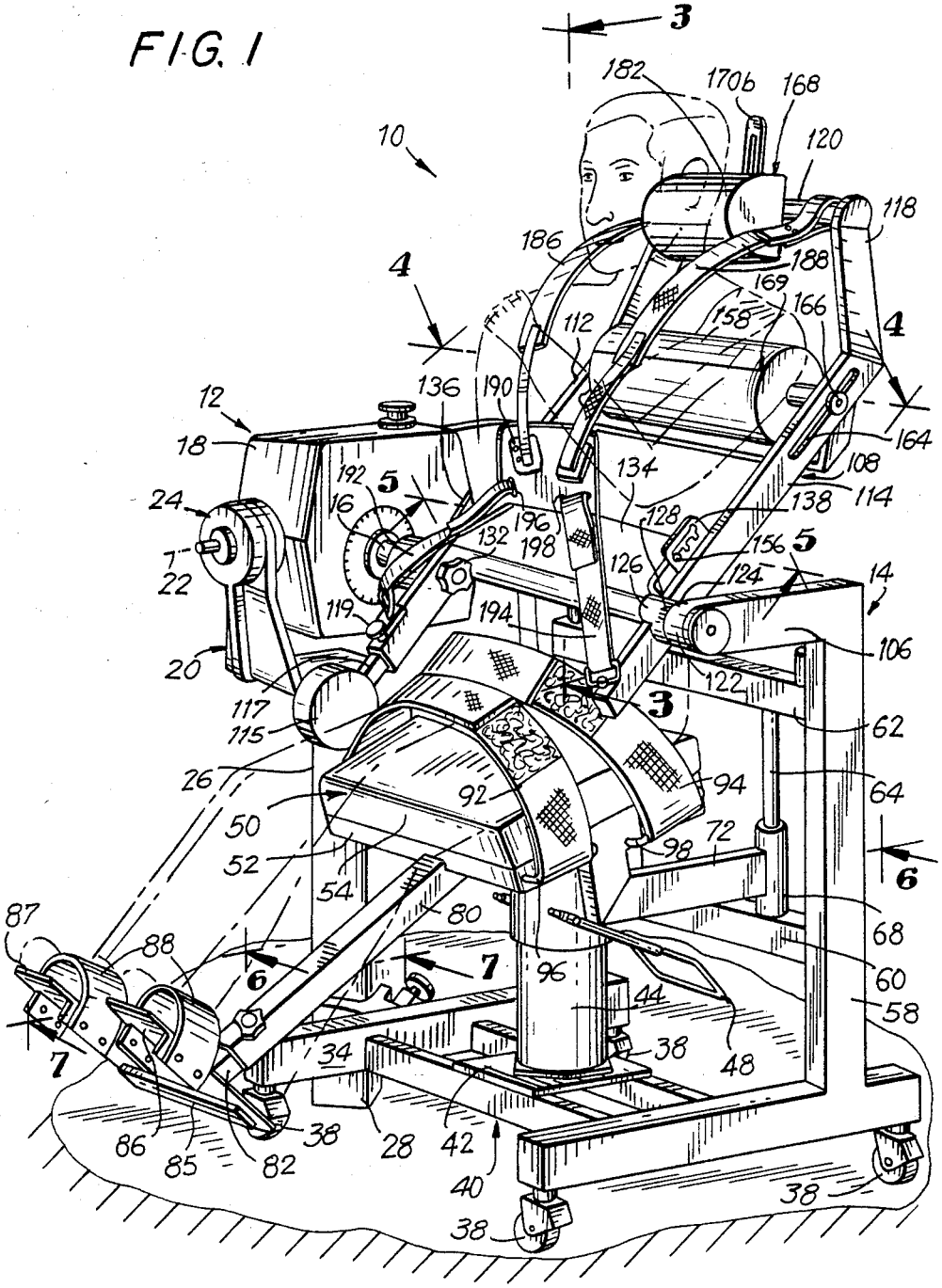
FIG. 1 is a perspective view of apparatus for exercising and rehabilitating the lower back according to the present invention.

Referring to the drawings in detail, apparatus 10 for exercising and/or rehabilitating the muscles of the upper lumbar region of the back of a patient includes a controller 12 of the identical type that is disclosed in U.S. Pat. No. 4,691,694 to the same assignee herewith, and a back attachment 14 connectable with controller 12 and actuated thereby. The entire disclosure of U.S. Pat. No. 4,691,694 is incorporated herein by reference, and accordingly, a detailed description thereof will be omitted from the present application for the sake of brevity. Suffice it to say that controller 12 generally includes an output shaft 16, which may be a direct output shaft from a servo motor or from a gear reducer attached to the servo motor, both encased within a housing 18 of controller 12. Housing 18, in turn, is mounted on a stand 20 for rotation about an axis 22, and can be tightened by a suitable tightening device 24 in any rotational position. Stand 20, in turn, is rotatably mounted in a horizontal plane at the upper end of a vertically telescoping portion 26 and can be locked by a suitable tightening device at any desired rotational position. Vertically telescoping portion 26, in turn, is mounted for vertical movement on a vertical support 28, and can be locked at any desired vertical position thereon by any suitable tightening device 30.

A plurality of strain gauges (not shown) are provided in association with output shaft 16 to sense the force applied to back attachment 14 and for producing a load signal in response thereto, and a speed detector (not shown), such as a tachometer or the like, is provided to produce a velocity signal corresponding to the speed of movement of back attachment 14, whereupon a closed loop servo circuit in controller 12 controls the servo motor in response to the load signal and the velocity signal to regulate the velocity of back attachment 14, for example, in an isokinetic mode, isotonic mode, passive (oscillation) mode or isometric mode.

Back attachment 14 includes a stand 32 comprised of spaced and parallel horizontally arranged support bars 34 and 36, each supported on casters 38 at opposite ends thereof. A central platform 40 interconnects horizontally arranged support bars 34 and 36, so that the latter are maintained in their spaced, parallel relation and also provides a support surface 42 on which a fixed vertical support column 44 is mounted. An inner telescoping post 46 slidably extends within fixed vertical support column 44 and is movable vertically therewith by means of a mechanism (not shown) therein, upon actuation of a foot pedal 48. The mechanism for moving inner telescoping post 46 vertically with respect to fixed vertical support column 44 is a conventional device, for example, and may be similar to devices commonly used in barbershops and dental offices.

A seat 50 is mounted at the upper end of inner telescoping post 46. Specifically, seat 50 includes a rigid seat base 52 secured to the upper end of inner telescoping post 46, and a seat cushion 54 mounted on rigid seat base 52. Thus, upon depression of foot pedal 48, seat 50 is caused to move vertically up or down. Generally, half strokes on foot pedal 48 cause seat 50 to be moved upwardly, and a full stroke that is held down, lowers seat 50.

In accordance with an important aspect of the present invention, seat 50 is inclined downwardly at a 15 degree descent relative to the horizontal. As a result, there is a pelvic tilt imparted to the patient which maintains lordosis throughout the range of motion of tilt by the pelvis. It has been found by the inventors herein that, if seat 50 is not inclined, that is, is horizontal, lordosis is maintained some of the time and is not maintained some of the time. Maintaining of lordosis is crucial to exercise of the lower back muscles.

Stand 32 also includes two vertical support posts 56 and 58 secured to support bars 34, 36, respectively, rearwardly thereof and rearwardly of fixed vertical support column 44. Thus, vertical support posts 56 and 58 are arranged in parallel, spaced relation at opposite sides of back attachment 14. A lower cross bar 60 and an upper cross bar 62 connect lower and upper ends of vertical support posts 56 and 58 together. As shown best in FIG. 2, two vertically oriented guid ebars 64 and 66 are connected between lower cross bar 60 and upper cross bar 62 in parallel, spaced relation. Guide sleeves 68 and 70 are slidably mounted on guide bars 64 and 66, respectively, for movement therealong between lower cross bar 60 and upper cross bar 62. L-shaped support beams 72 and 74 (FIGS. 1 and 6) are connected, at one end, to guide sleeves 68 and 70, respectively, and at opposite ends thereof to rigid seat base 52 to provide further stability to seat 50 . In other words, such arrangement prevents rotational movement of seat 50 on inner telescoping post 46, while also permitting seat 50 to be moved vertically with inner telescoping post 46.

In addition, as shown in FIGS. 1, 7 and 8, back attachment 14 includes an adjustable foot support assembly 76, which includes a hollow tubular support 80 fixedly connected to the front of rigid seat base 52 and extending downwardly therefrom at an angle of approximately 30 degrees. An inner telescoping support 82 is telescopically received within the lower end of hollow tubular support 80 and can be locked at different positions therealong by means of a screw locking mechanism 84. A flat support plate 85 is fixedly secured to the lower free end of inner telescoping support 82 in a substantially orthogonal manner thereto. A left foot rest plate 86 and a right foot rest plate 87 are secured to opposite sides of flat support plate 85, and a rigid arcuate strap 88 is connected to and is positioned above each foot rest plate 86 and 87. Thus, left and right foot rest plates 86 and 87 are secured to flat support plate 85 at sides thereof to enable placement of the patient's feet thereon without interference from inner telescoping support 82 and hollow tubular support 80. To adjust foot rest plates 86 and 87, when the patient is seated, inner telescoping support 82 is extended so that the femur are nearly parallel with the descent angle of seat 50. In such case, the knee angle will be approximately 15–30 degrees. In addition, various markings 90 are provided on inner telescoping support 82 so that the value indicated thereon may be entered for the particular patient so that adjustment can be easily made during subsequent treatments.

By reason of adjustable foot support assembly 76, there is a control of the amount of substitution, that is, the extent that other muscles come into play during exercise and rehabilitation of the lower back muscles. Specifically, parts of the hamstring and gluteous muscles are controlled to come into play, in order to avoid injury to the lumbar vertebrae and also, since these muscles are used in association with the back during normal functioning. Although the lumbar spine can be isolated completely, this is not very safe, because there is too much stress applied on the lumbar spine. Thus, substitution, which is controlled by adjustable foot support assembly 76, protects the lumbar spine and therefore functions as a protective mechanism. Generally, by lengthening inner telescoping support 82, the amount of substitution is reduced, and to the contrary, when shortening inner telescoping support 82, the amount of substitution is increased. Thus, there is selective control of substitution of the lower extremities, which is extremely important when exercising and rehabilitation the lower back muscles.

Figure 6:
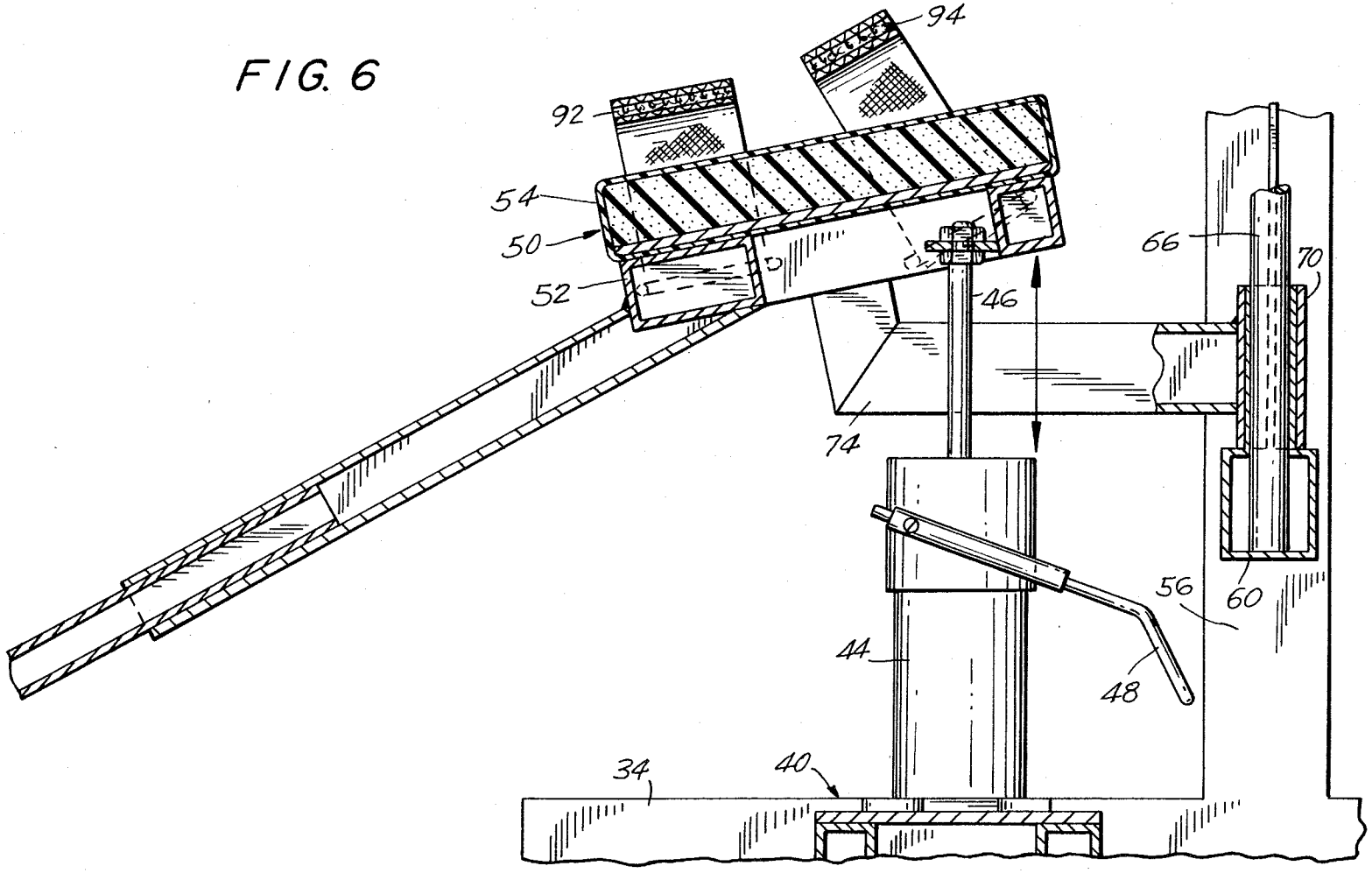
FIG. 6 is a cross-sectional view of the apparatus of FIG. 1 taken along line 6—6 thereof.

As shown in FIGS. 1 and 6, a femur securing strap 92 and a pelvic securing strap 94 are secured to seat base 52 for securing the patient on seat 50. Specifically, one end of each securing strap 92 and 94 is pivotally secured to respective handles 96 and 98 at one side of seat base 52. Thereafter, the opposite free ends extend through handles 100 and 102 (FIG. 2) at the opposite side of seat base 52 and then extend back toward handles 96 and 98, terminating substantially immediately above the femur and pelvic areas of the patient. The free ends of straps 92 and 94 have Velcro-type hooks (not shown) which are secured on Velcro-type fabric on the exposed surface of straps 92 and 94 so that straps 92 and 94 can be tightened and then secured about the upper legs and pelvic area of the patient.

Stand 32 further includes two horizontal support bars 104 and 106, which are secured to the upper ends of vertical support posts 56 and 58, respectively, and extend in spaced, parallel relation with each other and parallel to support bars 34 and 36, respectively. The free ends of support bars 104 and 106 are substantially in the same vertical plane as inner telescoping post 46. Support bars 104 and 106 are provided to rotatably support the upper body frame 108 of back attachment 14 which is the operating portion of back attachment 14 that is connected to and driven by output shaft 16 of controller 12.

Specifically, upper body frame 108 includes two parallel lower side frame bars 112 and 114 which are arranged in spaced, parallel relation. Upper side frame bars 116 and 118 are respectively secured to (or integrally formed with) the upper ends of lower side frame bars 112 and 114 and extend forwardly at an oblique angle therewith. The upper, free ends of upper side frame bars 116 and 118 are connected together by a cross bar 120. In addition, a counterweight 115 is secured to a bar 117 which is telescopically received within the lower end of lower side frame bar 112, and lockable at different positions therealong by a locking screw 119.

The free end of horizontal support bar 106 includes a bearing assembly 122 extending through an aperture thereof and has a single marking 124 on the outer surface thereof. A stub shaft 126 is secured to lower side frame bar 114 near the lower end thereof and is engaged with bearing assembly 122 so as to be rotatably supported thereby. Stub shaft 126 has a plurality of markings 128 thereon positioned adjacent marking 124 so that a measurement can be taken as to the angle of rotation of upper body frame 108.

At the free end of the opposite horizontal support bar 104, there is likewise provided a hollow stub shaft 130 (FIG. 2) secured near the lower end of horizontal support bar 104. The output shaft 16 of controller 12 extends through the free end of horizontal support bar 104 and through stub shaft 130 and is tightened to the latter by a tightening knob 132, whereby output shaft 116, upon rotation, also rotates lower side frame bar 112 and thereby upper body frame 108. Rotation of output shaft 16 is controlled in the same manner as described in the aforementioned U.S. Pat. No. 4,691,694, the entire disclosure of which has been incorporated herein by reference. It will be appreciated that upper body frame 108 is rotated about the fixed axis of output shaft 16.

A lumbar pad 134 is provided to support the lumbar region of the patient. Specifically, and with particular reference to FIGS. 1–3 and 5, lumbar pad 134 is a substantially rectangular foam pad which extends between lower side frame bars 112 and 114 and is supported thereby. Specifically, lower side frame bars 112 and 114 include lumbar support plates 136 and 138 which extend upwardly therefrom. Each plate 136 and 138 has a substantially rectangular configuration with a longer edge thereof secured to the upper surface of the respective lower side frame bar 112 and 114. Each lumbar support plate 136 and 138 includes a lengthwise slot 140 near the upper edge thereof and three contiguous and transverse locking slots 142, 144 and 146, as best shown in FIG. 3. Lumbar pad 134 has securing straps 148 and 150 secured at opposite edges thereof, with closed loop clasps 152 secured to the free ends of securing straps 148 and 150, each clasp 152 being bent, as shown in FIG. 3, to form a recessed section 154 which holds a supporting pin 156 that fits within one of transverse locking slots 142, 144 and 146 at opposite sides of lumbar pad 134. Accordingly, lumbar pad 134 can be adjusted in one of the respective transverse locking slots 142, 144 and 146 for the individual patient. In addition, since supporting pins 156 effectively support lumbar pad 134 and such supporting pins are pivotable, lumbar pad 134 is supported by lumbar support plates 136 and 138 in a pivotable manner, with the pivot point being through the axis connecting supporting pins 156 at opposite sides of lumbar pad 134.

It will be appreciated that an important aspect of the present invention is that the axis of rotation of the lumbar region of lumbar pad 134 is offset from the fixed axis of rotation of upper body frame 108 which is at the axis of output shaft 16 of controller 12. Thus, the axis of rotation of upper body frame 108 is lower than the axis of rotation of the lumbar region, that is, in the lumbosacral joint. This is because lumbar pad 134 cannot follow the fixed axis of rotation of output shaft 16 and must follow the axis of rotation of the lumbar spine. As a result, a separate rotation of the lumbar region and the entire back are provided. It will be noted that the axis of rotation of the back is known as the L5-S1 axis. Thus, these two separate axes of rotation pivot separately, because the need for support of the lumbar region changes.

Thus, lumbar pad 134 provides three distinct features. First, lumbar pad 134 can pivot separate and apart from the fixed axis of output shaft 16. Second, the position of lumbar pad 134 can be adjusted by means of placing supporting pins 156 in selected transverse locking slots 142, 144 or 146. Third and last, there is an offset of the pivoting axis of the lumbar region and the fixed L5-S1 axis of rotation of the back.

Figure 4:
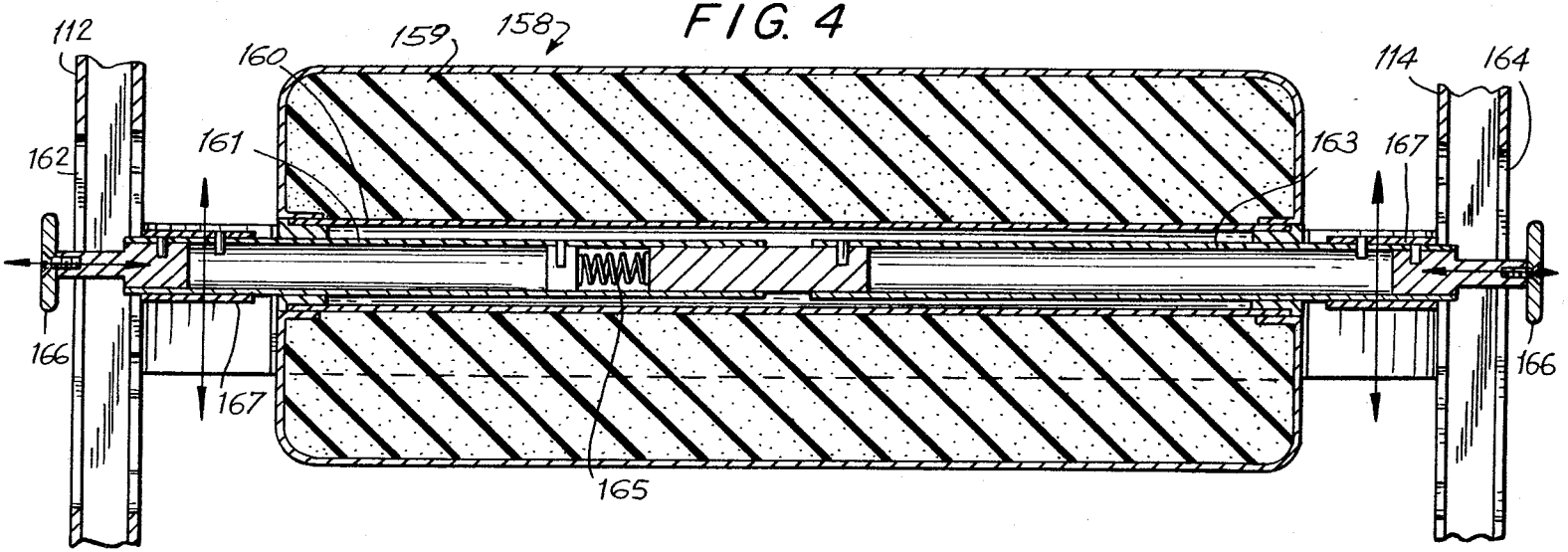
FIG. 4 is a cross-sectional view of the apparatus of FIG. 1, taken along line 4—4 thereof.
Figure 5:
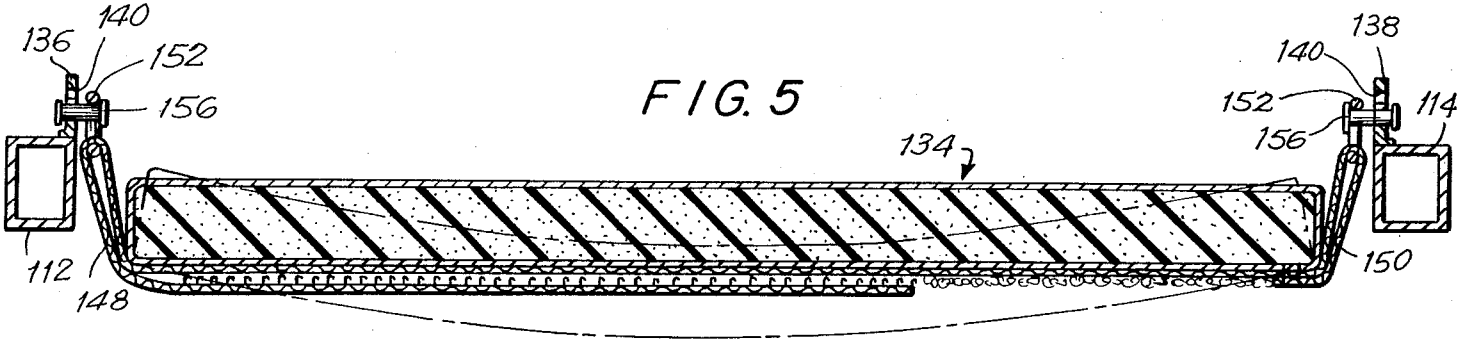
FIG. 5 is a cross-sectional view of the apparatus of FIG. 1, taken along line 5—5 thereof.

A scapula pad 158 is also connected between lower side frame bars 112 and 114 near the connection thereof to upper side frame bars 116 and 118, respectively. As shown best in FIG. 4, scapula pad 158 includes a cylindrical pad 159 secured on a central tube 160. An outer telescoping rod 161 extends from within central tube 160 out of one end thereof, partially through an elongated slot 162 in lower side frame bar 112, and an inner telescoping rod 163 extends from within central tube 160 out of the other end thereof, partially through an elongated slot 164 in lower side frame bar 114. Knobs 166 are connected to the free ends of telescoping rods 161 and 163 and extend from the opposite sides of lower side frame bars 112 and 114, through elongated slots 162 and 164, respectively, thereof. Inner and outer telescoping rods 161 and 163 are normally biased apart by a spring 165 therebetween, which is positioned within central tube 160. Accordingly, sleeves 167 are formed on the outer surface at the free ends of telescoping rods 161 and 163, each sleeve 167 having a diameter greater than the widthwise dimension of slots 162 and 164 to limit the extent of outward travel of telescoping rods 161 and 163.

In this manner, scapula pad 158 can be adjusted along the length of lower side frame bars 112 and 114 as follows. The user merely presses inwardly on knobs 166. As a result, telescoping rods 161 and 163 are moved toward each other, against the force of spring 165, whereby sleeves 167 are moved out of contract with lower side frame bars 112 and 114. The user then, while grasping knobs 166, moves scapula pad 158 to the desired height along slots 162 and 164, and then releases knobs 166. As a result, spring 165 biases telescoping rods 161 and 163 apart, causing sleeves 167 to frictionally engage lower side frame bars 112 and 114, so that scapula pad 158 is held in position. Thus, scapula pad 158 is adjustable for the particular patient. Preferably, scapula pad 158 should be positioned in between the spines of the scapulas and the inferior angles of the scapulas.

It will be noted that scapula pad 158 is rotatable and the positioning thereof should be proportional to the relationship between the lumbar and sacral axes. In addition, scapula pad 158 functions as an indicator of correct positioning of the seat height. Specifically, if the seat 50 is too high or too low, scapula pad 158 will rotate and such rotation will be noticeable. If the axis of rotation of the lumbar region is adjusted perfectly, scapula roll pad 158 will not roll at all, and will therefore be an indicator of the correct adjustment of the seat height. In this manner, cylindrical pad 159 includes a seam 169 that will rotate with scapula pad 158.

Figure 2:
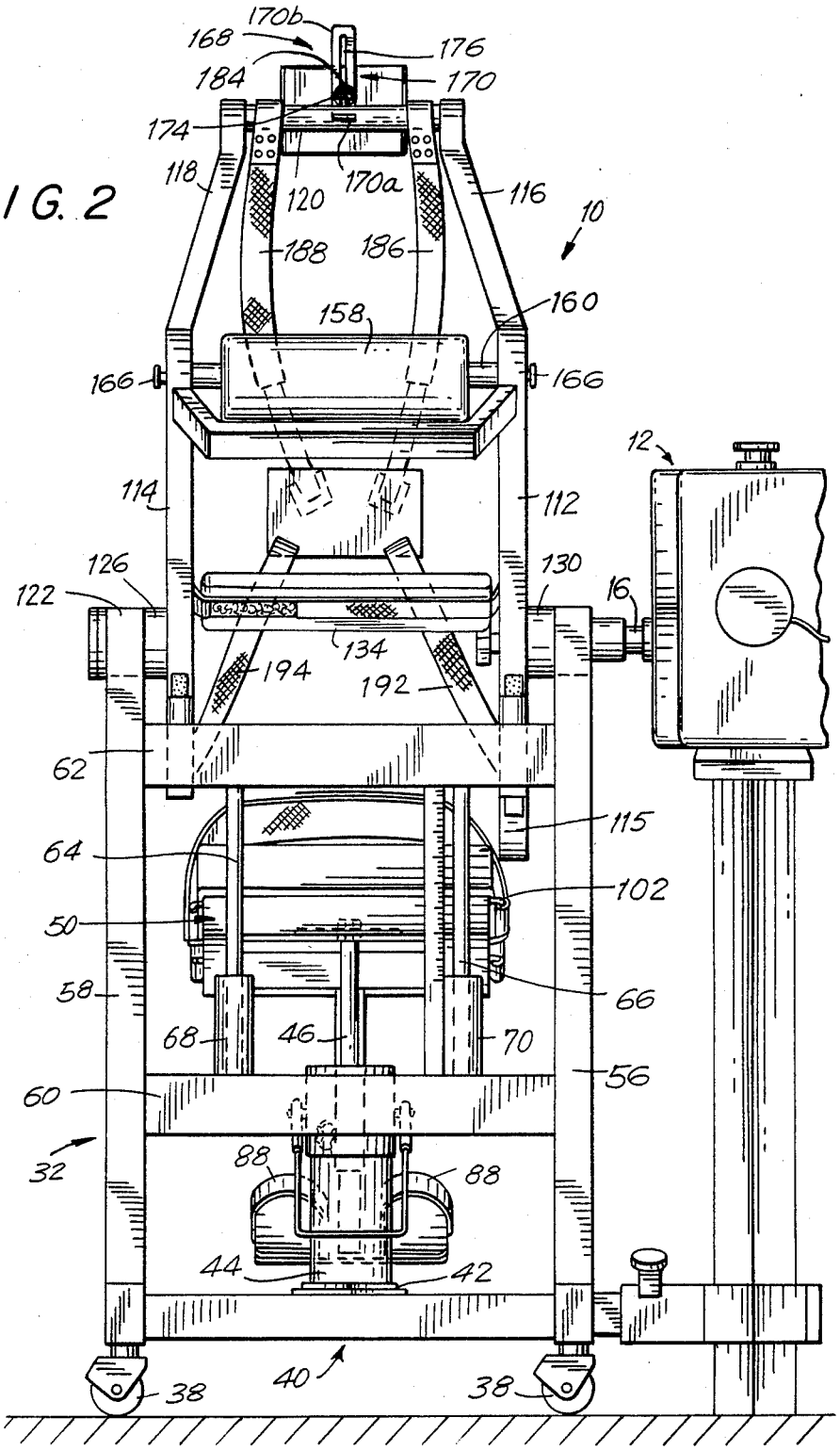
FIG. 2 is a rear elevational view of the apparatus of FIG. 1.
Figure 3:
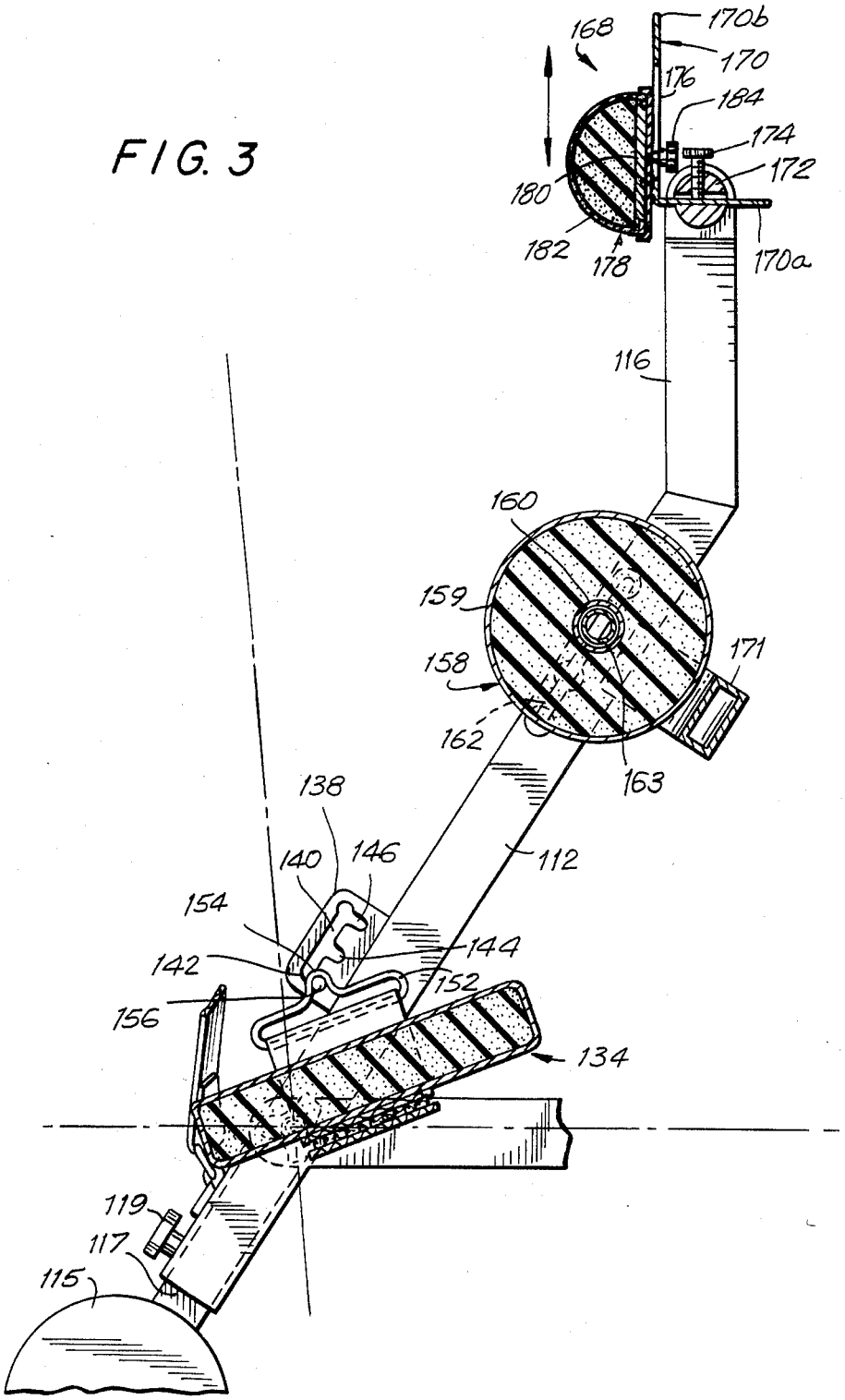
FIG. 3 is a cross-sectional view of the apparatus of FIG. 1, taken along line 3—3 thereof.

As shown in FIGS. 1–3, an intermediary cross bar 171 is provided behind scapula pad 158 and is fixed to lower side frame bars 112 and 114 to provide additional stability to upper body frame 108.

A cervical support 168 is also provided and is connected to cross bar 120. In accordance with the present invention, cervical support 168 can be adjusted vertically for the entire anthropomorphic range so as to support the cervical spine. Specifically, cervical support 168, as shown in FIG. 3, includes an L-shape support plate 170, one leg **170*a* of which fits within a horizontal slot 172 of cross bar 120 for movement in a horizontal plane. A locking bolt 174 extends in a vertical direction and is screw-threadedly received within cross bar 120 so as to engage support plate 170 extending through horizontal slot 172. Thus, L-shaped support plate 170 and thereby cervical support 168, can be adjusted in the horizontal plane of FIG. 3 for the individual patient. The vertical leg 170*b* of L-shaped support plate 170, which extends forwardly of cross bar 120, includes an elongated vertical slot 176 (FIG. 2) centrally therealong. Cervical support 168 also includes a head rest 178 formed by a rigid backing plate 180 and a semi-cylindrical pad 182 secured to backing plate 180 and against which the patient's head is adapted to rest. A locking bolt 184 extends from the rear of vertical leg 170*b* through vertical slot 176 and is screw-threadedly received within an aperture (not shown) in rigid backing plate 180. Accordingly, head rest 178 can be moved vertically with respect to vertical leg 170*b* of L-shaped support plate 170 within vertical slot 176 and locked at any position therein. Further, it will be appreciated that because of the arrangement with locking bolt 184, head rest 178 can also be rotated within vertical slot 176. As a result, head rest 178** can be adjusted with three degrees of freedom for the patient.

Lastly, in order to secure the patient's torso to upper body frame 108, securing straps are provided. Specifically, upper torso straps 186 and 188 are rotatably secured at an end thereof to cross bar 120 on opposite sides of cervical support 168. The opposite ends of upper torso straps 186 and 188 are connected to a torso plate 190. Lower torso straps 192 and 194 have one end pivotally connected to the lower ends of lower side frame bars 112 and 114, respectively. The opposite ends of lower torso straps 192 and 194 loop through apertures 196 and 198 in torso plate 190. The free ends of straps 192 and 194 have Velcro-type hooks (not shown) which are secured on Velcro-type fabric on the exposed surface of straps 192 and 194 so that straps 192 and 194 can be adjustably tightened, so as to adjustably tighten straps 186, 188, 192 and 194 and thereby secure the patient to upper body frame 108.

In operation, controller 12 is first switched to the "S setup" mode with the "standby" button depressed, as detialed in applicant's aforementioned copending U.S. Pat. No. 4,691,694. Then, the patient is seated and moved anteriorly or posteriorly to approximate the longitudinal spinal axis with the fixed axis of back attachment 14. Foot support assembly 76 is then adjusted so that the femur is substantially parallel to seat 50. The knee angle in such position will be approximately 15–30 degrees. At such time, the value indicated by markings 90 is noted for the particular patient. Next, the axis height is adjusted by pumping seat 50 up or down, using foot pedal 48. It is to be nioted that the axis of rotation for the lumbar spine is often indicated as the L5-S1 joint. This particular joint does have the largest range of flexion and extension motion of the lumbar vertebrae. Therefore, as the patient is positioned, it must be kept in mind that the patient's comfort is critical. Then, the lower extremity of the patient is stabilized firmly with pelvic and femur securing straps 894 and 92, respectively. The lumbar pad 134 is then adjusted to provide desired firmness for maximum patient comfort, and scapula pad 158 is also adjusted to rest between the level of the scapular spines and the inferior angles. In accordance with the present invention and from experience, it has been found that a good indicator of proper alignment of the patient within back attachment 14 is the absence of a significant amount of rolling of scapula pad 158 during trunk extension and part of the flexion motion. Then, cervical head rest 178 is adjusted to a position below the occipital protuberance. Then, torso straps 186, 188, 192 and 194 are applied firmly for maximum patient restrain and comfort.

Figure 10:
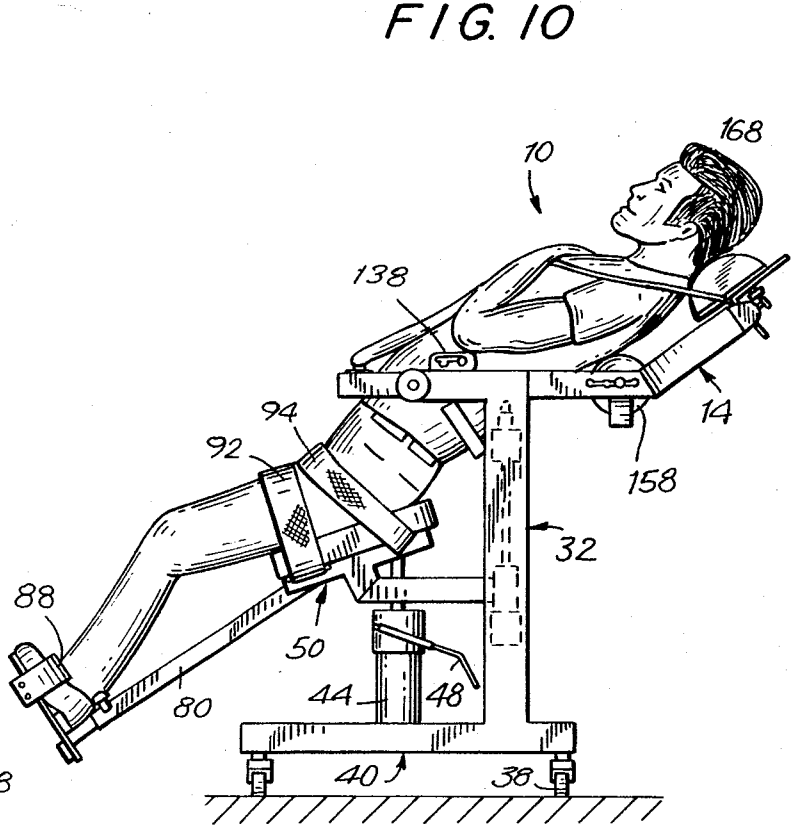
FIG. 10 is a side elevational view of the apparatus of FIG. 1, shown in use at a rear limit of the range of motion.
Figure 9:
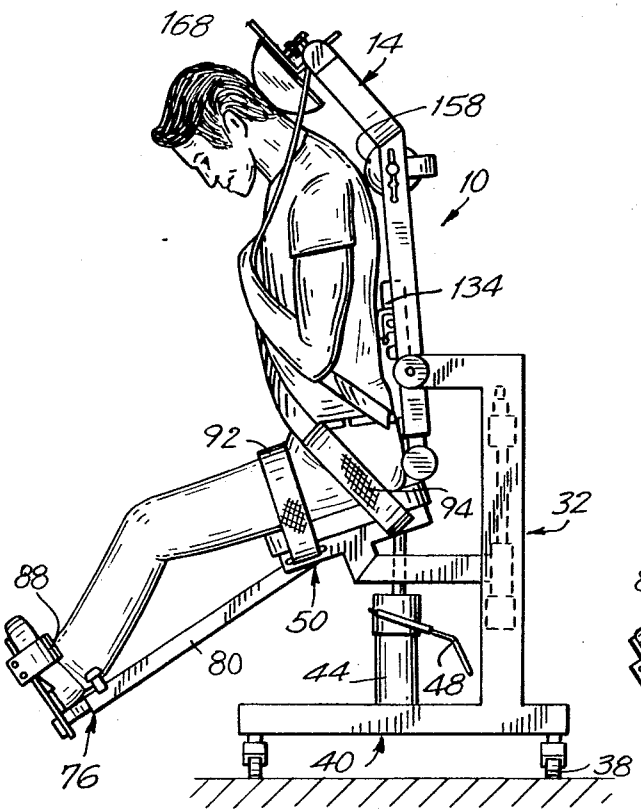
FIG. 9 is a side elevational view of the apparatus of FIG. 1, shown in use at a forward limit of the range of motion.
Figure 11:
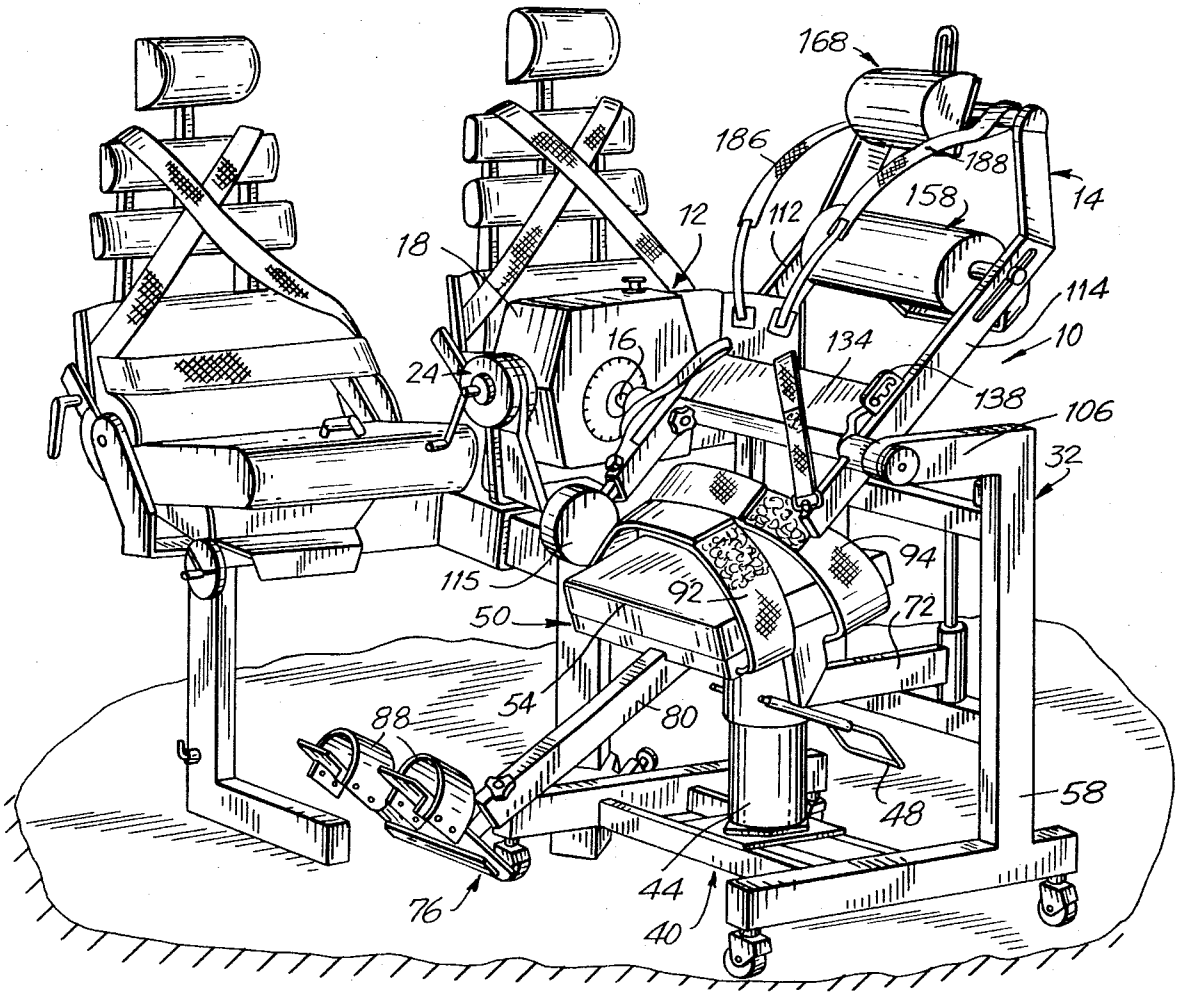
FIG. 11 is a perspective view of the apparatus of FIG. 1, taken from another view.

The patient is then manually assisted through the range of motion in the "S setup" mode as described in detail in the aforementioned U.S. Pat. No. 4,691,694 so as to determine if the axis of rotation is properly set. Then, positioning, stabilization, and all restraints are checked for possible readjustment. Thereafter, the range of motion limits are set in the "S setup" mode, while the patient is restrained in back attachment 14 in accordance with the teaching in U.S. Pat. No. 4,691,694, and thereafter, movement of back attachment 14 can be effected, for example, between the positions shown in FIGS. 9 and 10.

It will be appreciated, as described fully in the aforementioned copending U.S. Pat. No. 4,691,694, that controller 12 can operate in an isokinetic, passive (oscillation), isokinetic, or isometric mode. A distinct advantage of using the passive mode is that patients need not create any voluntary torque in order to move through a range of motion. Thus, patients that are restricted by pain during active contraction or weaknesses are aided by back attachment 14 until they can contribute. This mode is therefore recommended for postacute patients who have pain, restricted range of motion and weakness, along with patients who have not yet shown progress in their rehabilitation. As a sample protocol, a first set of ten repetitions at ten degrees per second can be used, followed by a second set of ten repetitions at twenty degrees per second, followed by a third set of ten repetitions at 40 degrees per second and finally use of other speeds up to 90 degrees per second will depend on the subject. This can be used to test for fatigue of the patient. In such case, it is important to note that fatigue is an important variable with respect to low back disorders. Therefore, fatigue can be gauged as a percent decrement in the average values for different trials. If the patient cannot perform ten repetitions, this is noted in the patient's records and is a sign of fatigue.

The isokinetic mode which is used with concentric loading in both directions is recommended for healthy athletes, end-stage rehabilitation, pre-employment screening and high-speed testing; and is particularly not recommended for acute mechanical pain or disc patients. A sample test in the isokinetic mode can be ten repetitions at 30 degrees per second, ten repetitions at 60 degrees per second, ten repetitions at 90 degrees per second and finally, an option of ten repetitions at 120 degrees per second.

Back attachment 14 can also be used for rehabilitation and exercise with submaximal eccentrics in the passive mode. Generally, eccentrics emphasize the elastic nature of the muscle and therefore a patient can work eccentrically at a greater physiological efficiency. This translates to greater patient compliance in many cases since the exercises are subjectively not as hard to perform. There is evidence that eccentric contractions can result in similar strength gains as concentric contractions. In early stages of rehabilitation, this may be attractive to the clinician and patient. In patients who are experiencing pain and/or weakness at specific positions, the passive motion can aid them through these points while they are able to relax the involved muscles.

Any rehabilitation protocol is dependent upon a number of factors. The clinicians will find it necessary to modify procedures to meet the demands of each particular patient. The aims of the rehabilitation are, in part, to improve range of motion, strength and endurance so that the patient can return to preinjury status with minimal chances of repeating the injury.

Accordingly, at the start of such testing, the speed is set at ten degrees per second. As the patient indicates signs of performance improvement, these speeds may be increased. As to the range of motion, the range is set until a patient indicates that he or she can work without significant pain. The torque limits are set at 150 foot-pounds and above, with twelve repetitions per set for submaximal effort and 3–5 sets per session.

A fourth mode is rehabilitation and exercise in the isokinetic mode. A patient who can successfully perform a passive eccentric protocol is a candidate for progression to an isokinetic protocol. Generally, the patient begins on slow speeds, for example, 30, 45 and 90 degrees per second, and as he indicates signs of improvement, these speeds may be increased. As to the range of motion, after the patient has graduated from passive/eccentric rehabilitation, he should be able to perform this protocol through a full range of motion. As to the number of repetitions, for speeds less than 210 degrees per second, ten repetitions per session will be performed at the patient's maximal effort. At speeds greater than 210 degrees per second, twenty repetitions per set is recommended.

Lastly, rehabilitation and exercise can be performed with apparatus 10 in the isometric mode. Isometrics have been shown to have the potential to significantly improve strength. They have an advantage in that they do not require protocols of long duration. However, they also have the disadvantage of having an effect primarily at the joint angle at which the exercise is performed. Isometrics can be performed on either or both directions of motion. It is recommended that both flexion and extension isometrics be performed. The full range of motion achieved by the patient should be divided into arcs equally separated by 20 degrees. Isometric exercise should be performed at each of these positions. The patient should be encouraged to exert a maximal effort at each position for each repetition. In the interest of patient's safety, an instruction not to hold his breath is in order. During the contraction, the patient should exhale evenly. Generally, three repetitions are performed at each trunk position with each repetition being for 3–5 seconds to emphasize strength or 9–12 seconds to emphasize endurance.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined in the appended claims.

PARTS DESIGNATION

| Number | Part |
|---|---|
| 10 | apparatus |
| 12 | controller |
| 14 | back attachment |
| 16 | output shaft |
| 18 | housing |
| 20 | stand |
| 22 | axis |
| 24 | tightening device |
| 26 | vertically telescoping portion |
| 28 | vertical support |
| 30 | tightening device |
| 32 | stand |
| 34 | horizontally arranged support bar |
| 36 | horizontally arranged support bar |
| 38 | casters |
| 40 | central platform |
| 42 | support surface |
| 44 | fixed vertical support column |
| 46 | inner telescoping post |
| 48 | foot pedal |
| 50 | seat |
| 52 | rigid seat base |
| 54 | seat cushion |
| 56 | vertical support post |
| 58 | vertical support post |
| 60 | lower cross bar |
| 62 | lower cross bar |
| 64 | vertically oriented guide bar |
| 66 | vertically oriented guide bar |
| 68 | guide sleeve |
| 70 | guide sleeve |
| 72 | L-shaped support beam |
| 74 | L-shaped support beam |
| 76 | adjustable foot support |
| 80 | hollow tubular support |
| 82 | inner telescoping support |
| 84 | screw locking mechanism |
| 85 | flat support plate |
| 86 | left foot rest plate |
| 87 | right foot rest plate |
| 88 | rigid arcuate strap |
| 90 | markings |
| 92 | femur securing strap |
| 94 | pelvic securing strap |
| 96 | handle |
| 98 | handle |
| 100 | handle |
| 102 | handle |
| 104 | horizontal support bar |
| 106 | horizontal support bar |
| 108 | upper body frame |
| 112 | lower side frame bar |
| 114 | lower side frame bar |
| 115 | counterweight |
| 116 | upper side frame bar |
| 117 | bar |
| 118 | upper side frame bar |
| 119 | locking screw |
| 120 | cross bar |
| 122 | bearing assembly |
| 124 | marking |

-continued

| PARTS DESIGNATION | |
|---|---|
| Number | Part |
| 126 | stub shaft |
| 128 | markings |
| 130 | stub shaft |
| 132 | tightening knob |
| 134 | lumbar pad |
| 136 | lumbar support plate |
| 138 | lumbar support plate |
| 140 | lengthwise slot |
| 142 | transverse locking slot |
| 144 | transverse locking slot |
| 146 | transverse locking slot |
| 148 | securing strap |
| 150 | securing strap |
| 152 | closed loop clasps |
| 154 | recessed section |
| 156 | supporting pin |
| 158 | scapula pad |
| 159 | cylindrical pad |
| 160 | central tube |
| 161 | outer telescoping rod |
| 162 | elongated slot |
| 163 | inner telescoping rod |
| 164 | elongated slot |
| 165 | spring |
| 166 | knobs |
| 167 | sleeve |
| 168 | cervical support |
| 169 | seam |
| 170 | L-shaped support plate |
| 170a | horizontal leg |
| 170b | vertical leg |
| 171 | intermediary cross bar |
| 172 | horizontal slot |
| 174 | locking bolt |
| 176 | vertical slot |
| 178 | head rest |
| 180 | rigid backing plate |
| 182 | semi-cylindrical pad |
| 184 | locking bolt |
| 186 | upper torso strap |
| 188 | upper torso strap |
| 190 | torso plate |
| 192 | lower torso strap |
| 194 | lower torso strap |

What is claimed is:

1. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said set means at a downward angle of approximately 15 degrees toward a front portion of said seat means, regardless of the angle of pivot of said back exercising means; and said back exercising means being pivotally connected to said support means along a pivot axis in line with said central axis;

securing means for securing the person to said seat means and said back exercising means.

2. A back attachment according to claim 1; further including adjustable foot rest means adjustably connected with said seat means for supporting the feet of the person thereon.

3. A back attachment according to claim 1; wherein said securing means includes a plurality of straps securable about the lower extremities of the person and the torso of the person.

4. A back attachment according to claim 3; wherein said securing means includes a femur strap securable about the femur of the person, a pelvic strap securable about the pelvis of the person and shoulder straps securable about the upper torso of the person.

5. A back attachment according to claim 1; further including means for raising and lowering said seat means.

6. A back attachment according to claim 1; further including slidable connection means connected between said support means and said seat means for permitting vertical movement of said seat means and for preventing rotation of said seat means.

7. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means; and adjustable lumbar support means connected with said back exercising means for supporting the lumbar region of the person in any selected one of a plurality of different positions.

8. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means; and lumbar support means connected with said back exercising means for supporting the lumbar region of the person about an axis offset from said central axis, during pivoting movement of said back exercising means.

9. A back attachment according to claim 8; further including lumbar support adjustment means for supporting said lumbar support means at a selected one of a plurality of different positions.

10. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means; and lumbar support means connected with said back exercising means for supporting the lumbar region of the person about an axis offset from said central axis, during pivoting movement of said back exercising means, said lumbar support means including an elongated lumbar pad, lumbar support plate means secured to opposite sides of said back exercising means, and connection means secured at opposite sides of said lumbar pad for pivotally connecting said lumbar pad to said lumbar support plate means.

11. A back attachment according to claim 10; wherein each said lumbar support plate means includes at least one aperture therein, and said connection means includes first and second straps, each strap having one end thereof connected to one side of said lumbar pad and having a pin at the opposite end thereof for pivotal engagement within said at least one aperture of a respective lumbar support plate.

12. A back attachment according to claim 11; wherein said at least one aperture of each lumbar support plate means includes a plurality of slots for supporting the respective pin therein at any selected one of a plurality of positions.

13. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means; and adjustable lumbar support means connected with said back exercising means for supporting the lumbar region of the person in any selected one of a plurality of different positions, said lumbar support means including an elongated lumbar pad, lumbar support plate means secured to opposite sides of said back exercising means, and connection means secured at opposite sides of said lumbar pad for pivotally connecting said lumbar pad to said lumbar support plate means.

14. A back attachment according to claim 13; wherein each said lumbar support plate means includes at least one aperture therein, and said connection means includes first and second straps, each strap having one end thereof connected to one side of said lumbar pad and having a pin at the opposite end thereof for pivotal engagement within said at least one aperture of a respective lumbar support plate.

15. A back attachment according to claim 14; wherein said at least one aperture of each lumbar support plate means includes a plurality of slots for supporting the respective pin therein at any selected one of a plurality of positions.

16. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means;

scapula support means for supporting the scapular region of the person;

scapular connection means for adjustably connecting said scapula support means to said back exercising means;

means for raising and lowering said seat means; and said scapula support means includes indicating means for indicating if said seat means is correctly adjusted in height.

17. A back attachment according to claim 16; wherein said scapula support means includes a cylindrical pad rotatably supported to said back exercising means.

18. A back attachment according to claim 16; wherein said scapula support means includes a cylindrical pad rotatably supported to said back exercising means; and said indicating means includes a seam along said cylindrical pad which rotates with said cylindrical pad when the height of said seat means is not correctly adjusted.

19. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means;

scapula support means for supporting the scapular region of the person; and scapular connection means for adjustably connecting said scapula support means to said back exercising means, said scapular connection means including means for adjusting said scapula support means vertically along said back exercising means, said means for adjusting including:

first and second rod means within said scapula support means, biasing means for biasing said first and second rod means apart, first and second elongated slots at opposite sides of said back exercising means, and knob means extending through said elongated slots and connected to free ends of said first and second rod means to slidably secure said first and second rod means with respect to said first and second slots.

20. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means;

cervical support means for supporting the cervical spine of the person; and cervical spine connection means for connecting said cervical support means to said back exercising means with three degrees of freedom of adjustment.

21. A back attachment according to claim 20; wherein said cervical support means includes a semi-cylindrical pad.

22. A back attachment according to claim 21; wherein said cervical spine connection means includes an L-shaped plate for connecting said cervical support means to said back exercising means, one leg of said L-shaped plate slidably connected to said back exercising means in a first plane, the other leg of said L-shaped plate having said cervical support means slidably connected thereto in a plane substantially transverse to said first plane.

23. A back attachment according to claim 22; wherein the other leg of said L-shaped plate includes an elongated slot therein, and said cervical spine connection means includes pin means extending through said slot and connected with said cervical support means for slidably and rotatably supporting said cervical support means with respect to said slot.

24. A back attachment according to claim 23; further including a first bolt screw-threadedly received in said back exercising means into contact with said one leg of said L-shaped plate for securing said one leg at a selected position in said first plane, and said pin means includes a second bolt screw-threadedly received in said cervical support means for securing said cervical support means at a selected rotatable and longitudinal position with respect to said slot.

25. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means;

said back exercising means being pivotally connected to said support means along a pivot axis in line with said central axis;

securing means for securing the person to said seat means and said back exercising means; and adjustable foot rest means connected to said seat means for supporting the feet of the person, during pivoting of the back exercising means, said adjustable foot rest means being adjustable along the length thereof toward and away from said seat means, said foot rest means including an outer telescoping tube connected to said seat means at an angle in the range of 15–30 degrees, an inner telescoping tube slidably received in said outer telescoping tube within said range of 15–30 degrees so as to control the amount of substitution and having a free end, and left and right foot rest plates secured to the free end of said inner telescoping tube at approximately right angles.

26. A back attachment for a muscle exercise and/or rehabilitation apparatus of the type having a motor driven output shaft with a central axis, said back attachment comprising:

seat means for supporting a person thereon;

back exercising means connected to said output shaft for pivoting the back of the person about said central axis when said person is supported on said seat means;

support means for supporting said seat means at a downward angle of approximately 15 degrees regardless of the angle of pivot of said back exercising means;

said back exercising means being pivotally connected to said support means along a pivot axis in line with said central axis;

securing means for securing the person to said seat means and said back exercising means;

adjustable foot rest means connected to said seat means for supporting the feet of the person, during pivoting of the back exercising means, said adjustable foot rest means being adjustable along the length thereof toward and away from said seat means;

lumbar support means connected with said back exercising means for supporting the lumbar region of the person about an axis offset from said central axis, during pivoting movement of said back exercising means, in any selected one of a plurality of different positions;

scapula support means for supporting the scapular region of the person; and scapular connection means for adjustably connecting said scapula support means to said back exercising means;

cervical support means for supporting the cervical spine of the person;

cervical spine connection means for connecting said cervical support means to said back exercising means with three degrees of freedom of adjustment.

* * * * *